United States Patent [19]

Budrys

[11] 4,251,184

[45] Feb. 17, 1981

[54] CENTRIFUGAL PUMP

[75] Inventor: Vitolis Budrys, La Mirada, Calif.

[73] Assignee: Kobe, Inc., Commerce, Calif.

[21] Appl. No.: 23,205

[22] Filed: Mar. 23, 1979

[51] Int. Cl.[3] ..... F04D 1/12

[52] U.S. Cl. ..... 415/89

[58] Field of Search ..... 415/88, 89

[56] References Cited

U.S. PATENT DOCUMENTS

| | | | |
|---|---|---|---|
| 3,671,136 | 6/1972 | O'Mara et al. | 415/89 |
| 3,994,618 | 11/1976 | Erickson | 415/89 |

*Primary Examiner*—Louis J. Casaregola

*Attorney, Agent, or Firm*—William C. Norvell, Jr.

[57] ABSTRACT

A centrifugal pump apparatus is provided for pumping fluids which includes a cylindrical housing rotatable about its central axis and defining a main pumping chamber. A stationary fluid intake passage extends radially outwardly of the central axis of the housing into the main pumping chamber and has a fluid pickup opening facing in a direction opposite to the direction of rotation of the housing and communicating with an outlet conduit. A substantially unobstructed radially extending annular inlet passage is defined and has a radially inner portion communicating with a fluid inlet and the radially outer portion communicating with the pumping chamber of the housing.

8 Claims, 2 Drawing Figures

CENTRIFUGAL PUMP

BACKGROUND OF THE INVENTION

1. Field of the Invention

The invention relates generally to a pumping apparatus and more particularly to a centrifugal pump incorporating two basic working parts; a rotating housing and a stationary pickup tube collector arm disposed within the interior thereof. The fluid to be pumped and/or cleaned enters the apparatus through a unique substantially unobstructed radially extending annular inlet passage resulting in a quiescent inlet flow of fluid to minimize pulsations within the pumping and/or cleaning chamber which would adversely affect the overall pumping and/or cleaning efficiency.

2. Description of the Prior Art

The basic structural details and operational characteristics of the centrifugal pump of this invention are illustrated and described in U.S. Pat. No. 3,384,024 entitled "Centrifugal Pump", William L. King, inventor. The prior art apparatus includes a rotating housing and a stationary pickup tube collector arm within the rotating housing. The fluid to be pumped enters an intake manifold and passes into the rotating housing wherein the velocity of the fluid is increased. Centrifugal force induced by the rotating housing forces the fluid introduced therein to the peripheral outer extremities of the rotating housing through a plurality of discrete radial passages which are typically formed in an end wall of the rotating housing. The centrifugal force induced by the rotating housing forces the fluid to the outer extremities of the radial passages from which the fluid is injected at high velocity and high pressure, if the pumping chamber is already filled with fluid, into the main pumping chamber. The velocity energy of the fluid within the pumping chamber is converted into additional energy as it jets into the pickup tube and thence to a discharge conduit. Since the rotating housing is caused to rotate at speeds in excess of 3,000 rpm, it has been found that the introduction of the fluid to be pumped into the main pumping chamber through a plurality of separate inlet passages has caused a pulsation or vibration of the pickup tube collector arm within the pumping and/or cleaning chamber resulting in a decreased pumping efficiency and premature fatique of the apparatus.

SUMMARY OF THE INVENTION

It is an object of the invention to produce a centrifugal pump apparatus having an inlet passage means for the fluid to be pumped capable of introducing a constant stream of inlet fluid.

Another object of the invention is to produce a centrifugal pump having a single stage capable of pumping fluids at high pressures.

Another object of the invention is to produce a centrifugal pump capable of separating particulate materials from a fluid to be pumped.

Another object of the invention is to produce a centrifugal pump capable of removing particulate contaminates from a transient fluid wherein the zone of particulate material is maintained in a quiescent state prior to being removed from the pumping chamber.

Another object of the invention is to produce a centrifugal pump apparatus capable of removing particulate contaminates from a transient fluid stream by centrifugal force employing a minimal number of moving parts.

Another object of the invention is to produce a centrifugal pump apparatus containing stationary pickup means which are exposed to minimal vibrational stresses.

Still another object of the invention is to produce a centrifugal pump apparatus having an unobstructed inlet passage for the fluid being pumped thereby enabling the apparatus to produce a high net positive suction head.

Still another object of the invention is to produce a centrifugal pump apparatus of simplified construction of low cost and requiring a minimum of maintenance.

The above objects, as well as other objects of the invention, may be achieved by a pump apparatus comprising a generally cylindrical housing rotatable about its central axis and defining a main pumping and/or cleaning chamber; a stationary pickup tube collector arm disposed within the main pumping chamber; and a substantially unobstructed radially extending annular inlet passage having the radially inner portion communicating with a fluid inlet and the radially outer portion communicating with the main pumping and/or cleaning chamber of the housing.

DESCRIPTION OF THE PREFERRED EMBODIMENTS

Figure 1:
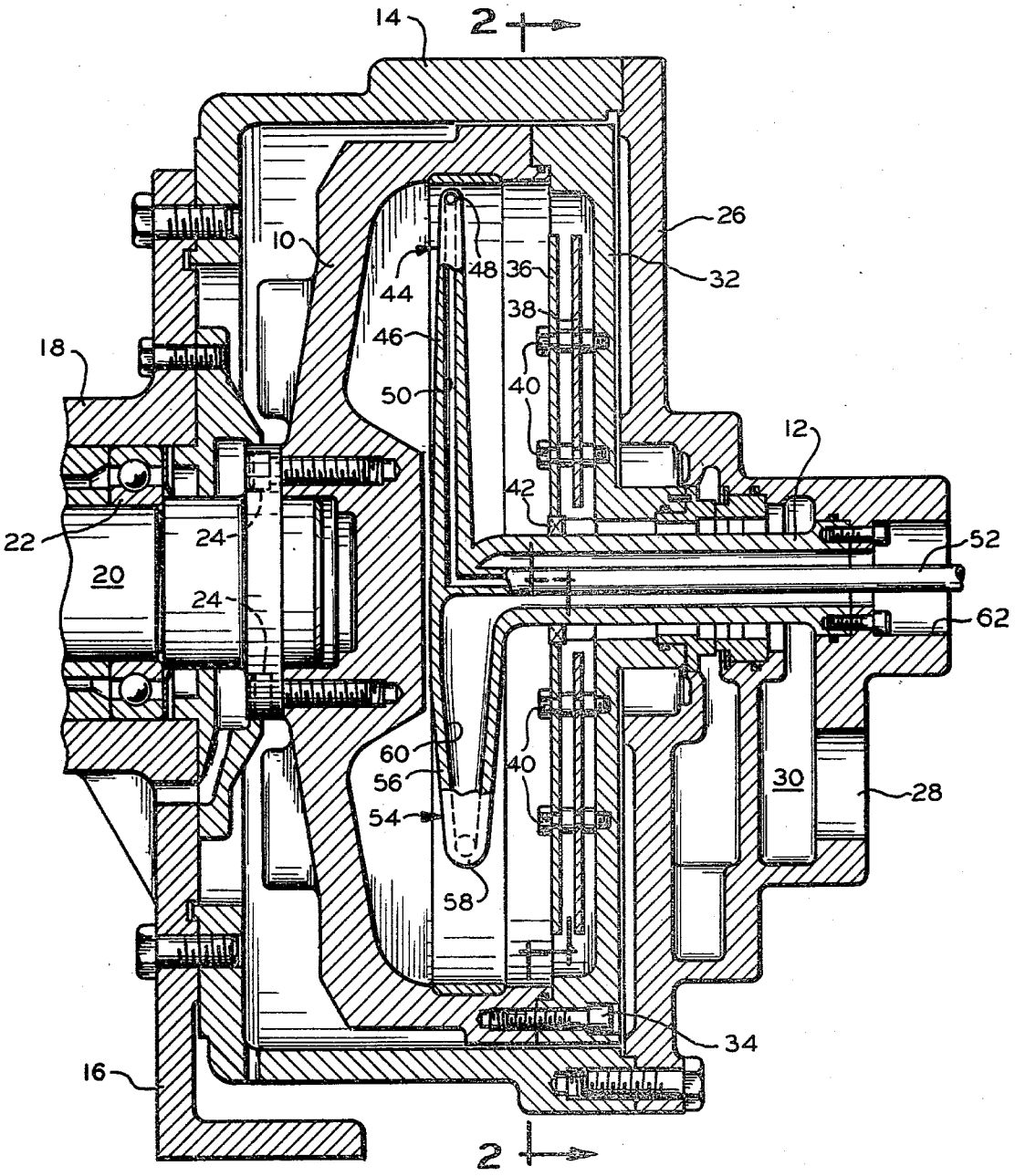
FIG. 1 is a sectional view of a centrifugal pump apparatus incorporating the features of the invention.
Figure 2:
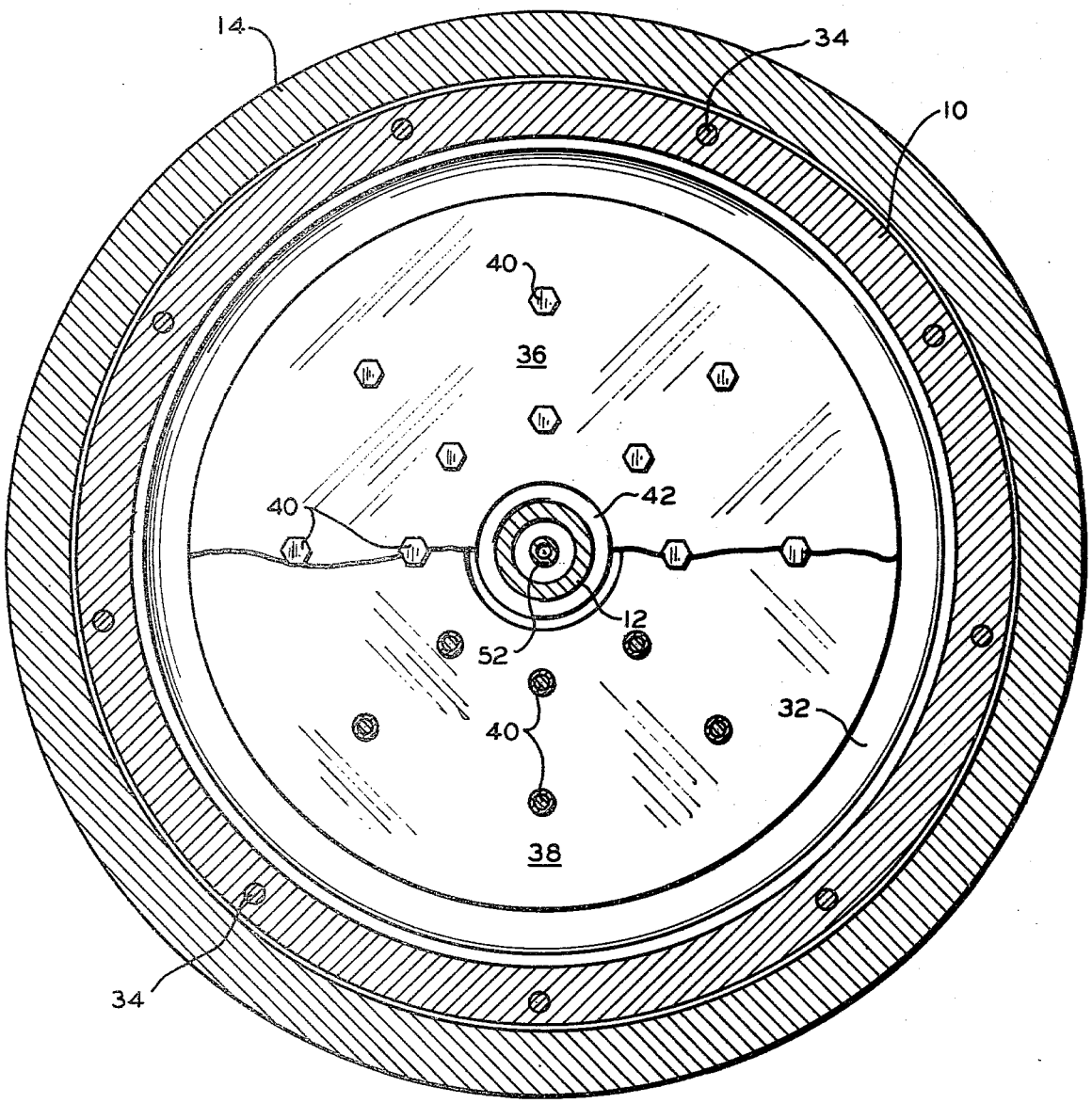
FIG. 2 is a sectional view of the apparatus illustrated in FIG. 1 taken along line 2—2 thereof.

Referring to the drawings, there is illustrated a centrifugal pump apparatus having a housing or casing 10 mounted to rotate relative to a fixed hollow internal shaft 12. The housing or casing 10 is rotatably mounted within an outer rotor housing 14 typically secured to a bearing pedestal 16, the bottom portion of which may be suitably secured to a load supporting base. The bearing pedestal 16 includes a generally horizontally extending cylindrical hollow sleeve 18. A drive shaft 20 is disposed coaxially within the hollow sleeve 18 and is rotatably supported therein by spaced apart bearing means 22, only the innermost one being illustrated. The innermost end of the drive shaft 20 is typically secured to the end wall of the rotatable housing 10 by means of a plurality of threaded fasteners 24. The opposite end of the rotor housing 14 from that which receives the drive shaft 20 is provided with a face plate 26 having an outwardly extending fluid inlet 28 and an associated inlet chamber 30.

The inlet chamber 30 is adapted to communicate with the inlet of the rotating housing 10. The inlet for the rotating housing 10 is typically formed on the inner face of an end plate 32 secured to the peripheral edges of the main housing 10 by spaced apart threaded fasteners 34. As is clearly illustrated in FIG. 1, a pair of spaced apart annular flat plates 36 and 38 are secured in parallel spaced relation to the inner surface of the end plate 32 by appropriately disposed threaded spacer elements 40. The plates 36 and 38 are positioned in coaxial relation about the shaft 12 and are secured generally normal to the axis of the shaft 12. A rotary seal element 42 is disposed between the outer surface of the internal shaft 12 and the inner annular edge of the annular flat plate 36.

Within the internal chamber of the rotatable housing 10, there is disposed a first pickup element 44 which includes a radially extending arm portion 46 and a generally circumferentially extending head portion 48 at the outer end of the arm 46. The pickup element 44 is stationarily mounted with respect to the shaft 12 and has an internal passageway 50 in communication with an outlet pipe 52 disposed within the interior of the hollow shaft 12. The pickup head 48 has a preferably circular intake opening at its leading end which extends forwardly of the leading edge of the arm portion 46 for optimum efficiency. The intake opening is in fluid communication with the internal passageway 50.

Generally diametrically opposed to the first pickup element 44 and disposed within the internal chamber of the housing 10, there is a second pickup element 54 which includes a radially extending arm portion 56 and a generally circumferentially extending head portion 58 at the outer end thereof. The pickup element 54 is stationarily mounted at the inner end of the shaft 12 and has an internal passageway 60 in communication with the hollow interior of the shaft 12. The pickup element 54 has a preferably circular intake opening at the leading end thereof which extends forwardly of the leading edge of the arm portion 56 for optimum efficiency. The intake opening is in fluid communication with the internal passageway 60.

It will be noted that the length of the radial arm 56 of the pickup element 54 is radially shorter than the corresponding arm portion 46 of the pickup element 44. As will become manifest during the description of the operation of the apparatus, the pickup element 44 is employed to receive and remove particulate material which collects in the internal chamber of the housing 10 adjacent the outer peripheral portion thereof, while the pickup element 54 is employed to receive and conduct away the liquid being pumped.

In operation, the drive shaft 20 is typically connected to a rotary motor drive means such as an electric motor which will impart rotation to the housing or casing 10 at speeds which may be in excess of 3,000 rpm. As the housing or casing 10 is caused to be rotated, the fluid, such as water, is drawn from a source, not shown, through the inlet 28 into the inlet chamber 30 of the face plate 26 and thence into the annular inlet passageway defined by the spaced apart plates 36 and 38 and the corresponding inner wall of the end plate 32. The centrifugal force caused by the rotation of the chamber 10 causes the fluid to enter into the interior of the rotating housing 10 under pressure. In the event the fluid being pumped contains any particulate contaminants, these particulates are forced to the outer extremities of the inner peripheral surface of the housing 10 and will concentrate in an annular zone. Since the inlet opening of the head portion 48 of the pickup element 44 is disposed within the region at which the particular material is concentrated, an inlet end of the head portion 48 will "inhale" the particulate material and conduct the same through the internal passsageway 50 through the outlet circuit 52.

The liquid which has assumed an annular zone radially inwardly of the annular zone of particulate material, is "inhaled" by the inlet opening of the head portion 58 of the pickup element 54. The velocity energy of the liquid being "inhaled" by the inlet opening of the head portion 58 of the pickup element 54 is converted into additional energy as it jets into the pickup tube and into the internal passageway 60. From the internal passageway 60, the liquid is caused to travel to the liquid outlet 62 through the hollow interior of the shaft 12.

The substantially unobstructed annular inlet passage defined by the plates 36, 38 and the facing inner surface of the end plate 32 make possible the introduction of pulse-free liquid into the pumping chamber of the housing 10. The structure results in producing a pump apparatus wherein an increase is achieved in the net positive suction characteristics over similar centrifugal pumping apparatus; the establishment of a rather quiescent zone of particulate concentration enabling the efficient collection and discharge thereof; and the elimination of a source of vibration which would have deleterious effects on the apparatus.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A centrifugal pump apparatus for pumping fluid comprising: a generally cylindrical housing rotatable about its central axis and defining a main pumping chamber; an unobstructed annular fluid inlet formed coaxial with said housing for directing fluid to be pumped into a periphery of the main pumping chamber of said housing; a stationary fluid pickup passage means extending radially outwardly of the central axis of said housing into the main pumping chamber thereof, said passage means including a fluid intake opening at the outermost end thereof, a fluid outlet in communication with the opposite end of said passage means, and wherein said unobstructed fluid inlet includes radially extending annular substantially flat surface elements having the radially inner portions adapted to communicate with a source of fluid and the radially outer portions communicating with the interior of the main pumping chamber of said housing.

2. The invention defined in claim 1 wherein said annular fluid inlet is formed by a surface of a flat annular plate member and an inner facing surface of said housing.

3. The invention defined in claim 2 wherein said plate member is coaxial with the coaxial with the central axis of said housing.

4. The invention defined in claim 2 wherein said plate member is rotatable with said housing.

5. The invention defined in claim 2 wherein said plate member is integral with said housing.

6. The invention defined in claim 2 including a plurality of spaced apart plates affixed to and spaced from an inner surface of said housing.

7. The invention defined in claim 1 further comprising a stationary particulate pickup passage means extending radially outwardly of the central axis of said housing into the main pumping chamber thereof, said passage means including a particulate intake opening at the outermost end thereof; and a particulate outlet in communication with the opposite end of said passage means.

8. The invention defined in claim 7 wherein said particulate intake opening is disposed in the region of the periphery of said housing.

* * * * *